US009079331B2

(12) United States Patent
Smith et al.

(10) Patent No.: US 9,079,331 B2
(45) Date of Patent: Jul. 14, 2015

(54) GEMSTONE ALIGNMENT

(75) Inventors: James G. C. Smith, Buckinghamshire (GB); Graham R. Powell, Berkshire (GB)

(73) Assignee: De Beers Centenary AG, Luzern (CH)

( * ) Notice: Subject to any disclaimer, the term of this patent is extended or adjusted under 35 U.S.C. 154(b) by 375 days.

(21) Appl. No.: 13/382,365

(22) PCT Filed: Jul. 7, 2010

(86) PCT No.: PCT/GB2010/051117

§ 371 (c)(1),
(2), (4) Date: Mar. 22, 2012

(87) PCT Pub. No.: WO2011/004189

PCT Pub. Date: Jan. 13, 2011

(65) Prior Publication Data

US 2012/0167362 A1 Jul. 5, 2012

(30) Foreign Application Priority Data

Jul. 10, 2009 (GB) ..... 0911989.2

(51) Int. Cl.
*B28D 5/00* (2006.01)
*B24B 9/16* (2006.01)

(52) U.S. Cl.
CPC ..... *B28D 5/0094* (2013.01); *B24B 9/167* (2013.01); *Y10T 29/23* (2015.01); *Y10T 29/49998* (2015.01)

(58) Field of Classification Search
CPC .... B25B 11/005; B25B 11/007; B23Q 1/035; B23B 31/307; B25J 15/0616; B28D 5/0094; B24B 9/167; Y10T 29/49998; Y10T 29/23
USPC ..... 29/10, 281.1, 281.5, 559; 269/20, 21, 269/75, 266, 329; 81/7
See application file for complete search history.

(56) References Cited

U.S. PATENT DOCUMENTS 3,721,465 A 3/1973 Kraissl, Jr.
3,797,177 A * 3/1974 Hoffman ..... 451/271

(Continued)

FOREIGN PATENT DOCUMENTS

BE 1 006 016 A3 4/1994
CN 101374741 A 2/2009

(Continued)

OTHER PUBLICATIONS

GB Search Report for corresponding British Application No. GB 0911989.2 dated Nov. 5, 2009.

(Continued)

*Primary Examiner* — David Bryant
*Assistant Examiner* — Lee A Holly
(74) *Attorney, Agent, or Firm* — Renner, Otto, Boisselle & Sklar, LLP

(57) ABSTRACT

An apparatus and method for aligning a gemstone such as diamond (106) with a predetermined vertical axis (108) is described. The apparatus includes an upwardly extending nozzle (105) aligned with the vertical axis (108) and sized to allow the gemstone (106) to settle into it under the action of gravity so that the article is supported by the aperture. A fluid supply system supplies fluid to the nozzle (105) under sufficient pressure to support the article within or above the aperture. A fluid pressure control system controls the pressure of fluid supplied to the nozzle (105), so that it can be reduced gradually.

31 Claims, 2 Drawing Sheets

(56) References Cited

U.S. PATENT DOCUMENTS

| | | | | |
|---|---|---|---|---|
| 5,427,363 | A * | 6/1995 | Rink et al. | 269/21 |
| 6,619,930 | B2 * | 9/2003 | Jansen et al. | 417/390 |
| 7,681,811 | B2 * | 3/2010 | Geser et al. | 239/548 |
| 8,016,605 | B2 * | 9/2011 | Montena et al. | 439/322 |
| 2002/0025677 | A1 * | 2/2002 | Uchiyama | 438/689 |
| 2003/0048448 | A1 * | 3/2003 | Fleming et al. | 356/423 |
| 2006/0201226 | A1 * | 9/2006 | Laupheimer et al. | 72/351 |

FOREIGN PATENT DOCUMENTS

| | | | |
|---|---|---|---|
| EP | 0 347 253 | A2 | 12/1989 |
| JP | 61033831 | A | 2/1986 |
| JP | 61168439 | A | 7/1986 |

OTHER PUBLICATIONS

International Search Report for corresponding International Application No. PCT/GB2010/051117 mailed Oct. 21, 2010.

Bernoulli Ball Blower, http://www.Ideo.columbia.edu/~ant/BernoulliBallBlower/index.html, printed from the Internet on Jan. 4, 2012.

International Preliminary Report on Patentability for corresponding International Application No. PCT/GB2010/051117 dated Jan. 10, 2012.

Chinese Office Action for corresponding Chinese Application No. 201080039398X issued Feb. 11, 2014 (with English translation).

* cited by examiner

GEMSTONE ALIGNMENT

The present invention relates to the alignment of a gemstone such as a diamond.

In order to observe or measure a property of a gemstone such as a diamond, or to align the gemstone prior to other operations, it is desirable for the orientation of the stone to be set in a consistent and repeatable manner relative to the apparatus with minimal operator effort.

For example, in order to observe an inscription on the table facet of a polished diamond gemstone, viewing means may be arranged to look directly at the table facet of the gemstone with the intention that a line or ray of light, defining a nominal axis drawn from the centre of the table facet of diamond to the centre line of the viewing system (which may be the centre of the entrance pupil) should be a normal to the table facet. In other words, the viewing means are intended to look directly at the centre of the table facet along an axis normal to the table facet.

Other arrangements are possible, such as illumination and viewing means being provided at equal angles either side of a nominal axis which should be a normal to the table facet. In general the alignment may need to be achieved to a specific tolerance that will depend on the aperture of the system.

In a further example it may be desired to measure the appearance of a diamond where illumination is provided from at least one specified angular position relative to the normal of the table facet. In such an apparatus inconsistent results will be obtained unless the orientation of the normal to the table facet can be set in a reliable manner.

It is possible to achieve a satisfactory alignment by a process which involves resting the gemstone with the table facet face downwards onto a glass window which has been preset at a desired orientation. This arrangement has the advantage that intimate contact between the table facet and the glass window allows the alignment to be achieved without having to provide further tilt adjustments. However, a centring adjustment may still be needed. Furthermore, reflections from the glass window and interference fringes between light reflected from the upper surface if the glass window and the table facet can be detrimental to image quality. These problems may be mitigated by providing the glass with an anti reflection coating, but such coatings are fragile and may easily be scratched by a gemstone or otherwise damaged, and may also become dirty or contaminated. This technique is therefore not ideal for any situation requiring precision measurements.

Another common approach is to place the polished gemstone in a cone shaped opening or funnel, so the gemstone sits in the cone with the table facet uppermost with the girdle facets supported by the lip of the cone. For a circular gemstone such as a round brilliant cut diamond a simple circular cone may be used, while other shapes may benefit from a matching complementary opening. The cone may have a small hole at the bottom, which leads via piping to a vacuum pump, often provided with simple control means such a switch so that the operator my activate the pump to provide a vacuum. Such apparatus may be described as a vacuum chuck.

It is preferable for such an apparatus to be designed and aligned so that the table facet is horizontal once the stone has settled in place. Gravity will tend to pull the stone into the hole and, in the absence of friction, the gemstone will settle in a stable equilibrium position at a point where the centre of gravity of the stone is at the lowest possible position and at a point of minimum potential energy. For diamonds with a degree of symmetry, and especially for round brilliant cut diamonds in a circular cone, a single equilibrium point will exist (but for a rotation about the vertical axis) and this will correspond to the desired orientation. If provided, the vacuum pump may be activated so that atmospheric pressure, acting on the upper side of the diamond may hold the gemstone in place.

Unfortunately, friction between the gemstone and the cone prevents the diamond settling into the point of stable equilibrium. Although the friction may be reduced, by selecting suitable materials or finishing for the inner surface of the cone, it cannot be eliminated, and this limits the accuracy of this alignment method. Even applying the vacuum does not in general force the diamond into the ideal position because the friction increases in proportion to the force applied by the atmosphere.

The invention provides a method and apparatus for overcoming or reducing the errors associated with the alignment process. The invention further provides a method and apparatus for reducing the time or level of skill required by an operator to facilitate alignment.

In accordance with one aspect of the present invention there is provided an apparatus for aligning an article with a predetermined vertical axis. The apparatus comprises a nozzle or orifice which, in use, extends (and may diverge) upwardly and is aligned with the vertical axis. The nozzle is sized to allow the article to settle therein under the action of gravity so that the article is supported by the nozzle. A fluid supply system supplies fluid to the nozzle under sufficient pressure to support the article within or above the nozzle. The fluid supply system includes a fluid pressure control system for controlling the pressure of fluid supplied to the nozzle.

This enables the article (such as a gemstone) to be supported on a cushion of fluid (e.g. air) just above, or within the upper portion of, the nozzle. The fluid pressure control system may be arranged to reduce the fluid pressure at the nozzle to about atmospheric pressure or below gradually over a finite period of time (generally between a few tenths of a second to a few seconds, e.g. in the range of about 0.1 seconds to about 10 seconds, more preferably about 0.1 seconds to about 5 seconds). This allows the article to settle gradually into the nozzle at the point of minimum potential energy.

The fluid supply system may include a pump arranged to deliver high pressure fluid towards the nozzle along a fluid path and a means for interrupting (or reversing) the supply of high pressure fluid. The fluid pressure control system may be provided in the fluid path and arranged to elongate the timescale of a fluid pressure change at the pump. This has the effect that, when the supply of high pressure fluid from the pump is interrupted, the fluid pressure at the nozzle is reduced over the finite period of time. "High pressure" in this context will be understood to mean a pressure high enough that the article can be supported by the fluid cushion above or within the nozzle.

The fluid pressure control system may include a hydraulic accumulator and/or a needle valve. High pressure fluid from the pump may be stored by the accumulator and passed through the needle valve towards the nozzle. When the supply of high pressure fluid from the pump is interrupted, the accumulator will discharge the store of fluid stored within it through the needle valve, resulting in the gradual reduction of pressure at the nozzle. The interruption of the supply of high pressure fluid from the pump may be provided by a high pressure valve attached to a high pressure outlet of the pump and movable between an activated state, in which the high pressure fluid is directed towards the nozzle along the fluid path, and an inactivated state, in which the high pressure fluid is not directed through the fluid path towards the nozzle.

The pump may also include a low pressure outlet connectable to the fluid path. This enables the generation of a low fluid pressure or vacuum at the nozzle beneath the article to enable the article to be held in place by atmospheric pressure once it has settled in the nozzle under gravity. The generation of the low fluid pressure or vacuum should also take place gradually. It will be appreciated that it need not be a "two-stage" process: the pressure at the nozzle may be reduced from above-atmospheric to below-atmospheric in a continuous process, so that the pressure differential across the article at the nozzle helps the settling process.

The nozzle may be any suitable shape, depending on the shape of the article to be aligned. In one embodiment (suitable for aligning a round brilliant-cut gemstone such as diamond), the upward facing portion of the nozzle is generally internally conical, optionally with an included angle in the range of about 45° to about 110°, preferably about 60° to about 90°.

The nozzle may be formed as an aperture in a top surface of a support member, which can make it easier to ensure that the nozzle is aligned with the vertical axis, especially if the support member generally extends horizontally. The support member may be formed from a lower member and a removable upper member, the aperture being provided in the upper member. This enables the provision of a range of interchangeable upper members with different apertures to suit different shapes and sizes of articles and gemstones.

The support member may be mounted on a two-axis goniometer to provide further precision to the alignment. The nozzle or support member (or upper member) may be made from or lined with polyoxymethylene plastic (or any material having a low friction co-efficient with the article being aligned) to reduce friction.

A chamber may be formed beneath the nozzle for controlling the flow of fluid into the nozzle. This may enable the fluid flow to be optimised to assist the settling process.

The invention also provides an assembly for viewing a gemstone, including the apparatus as described above and a viewing apparatus aligned along the vertical axis. This allows a gemstone located in the nozzle and aligned as described above to be viewed by the viewing apparatus.

In accordance with another aspect of the present invention there is provided a method of aligning an article such as a gemstone with a vertical axis. The method includes placing the article in an upwardly extending nozzle aligned with the vertical axis. Fluid under pressure is supplied to the nozzle, so that the article is supported on a fluid cushion within or above the nozzle. The pressure of the fluid is gradually reduced so as to allow the article to settle in the nozzle under gravity so that it is supported by the nozzle.

In accordance with another aspect of the present invention there is provided a method of levelling a top surface of an article such as a gemstone. The article is placed in an upwardly extending nozzle. Fluid under pressure is supplied to the nozzle, so that the article is supported on a fluid cushion within or above the nozzle. The pressure of the fluid is gradually reduced so as to allow the article to settle in the nozzle under gravity so that it is supported by the nozzle with its top surface level.

Some preferred embodiments of the invention will now be described by way of example only and with reference to the accompanying drawings, in which.

Figure 1:
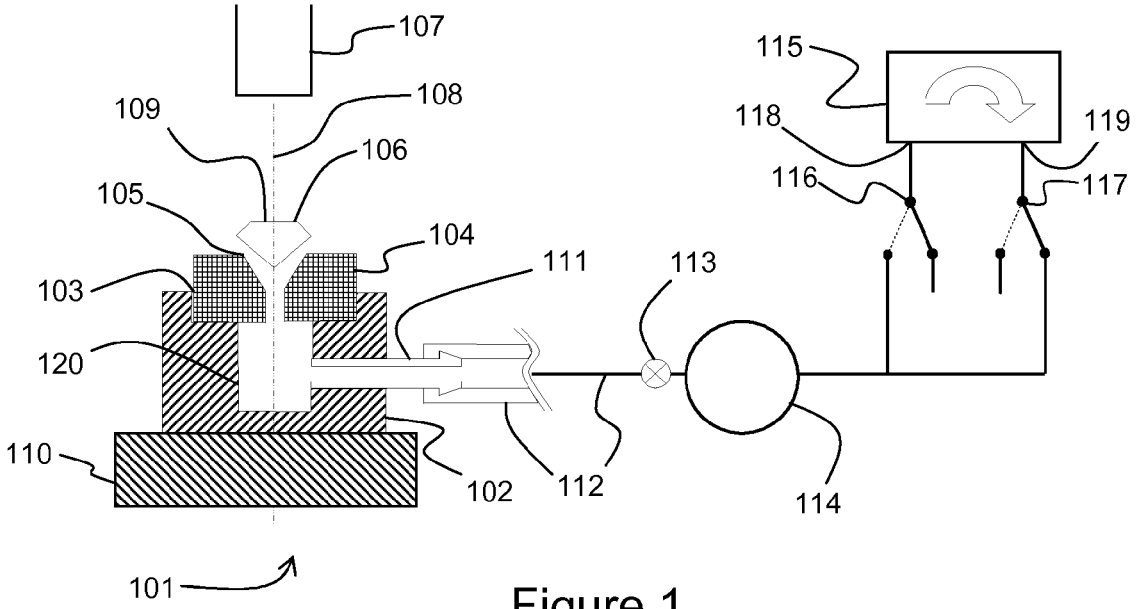
FIG. 1 is a schematic diagram of an alignment mechanism for a gemstone.

FIG. 1 is a section view of a holder for a diamond or other gemstone. The following discussion will concentrate on the alignment of a diamond but it will be appreciated that it applies equally to the alignment of any cut stone, or indeed any article with a suitably regular shape. The holder consists of a lower support member 102 with a recess 103 which receives an upper member 104. The upper member 104 may be fitted in and retained by suitable means (not shown) such as friction, a grub screw, threads or the like. The upper member 104 may be made from, or lined, with a material with a low coefficient of friction to diamond such as polyoxymethylene plastic (often known as Delrin®) and is provided with an aperture 105 in its upper surface which forms a nozzle into which, in operation, a round brilliant cut diamond 106 is placed. In this example the aperture 105 has a cone shaped profile, although it will be appreciated that any shape may be used, provided the diameter of the aperture 106 is such that there is at least one position in which the gemstone 106 may be supported as illustrated with contact between the lower (pavilion) facets of the gemstone 106 or the girdle and the upper lip or inner surface of the aperture 105. For example, typical round brilliant cut diamonds in the size range of 0.2 ct to 1.0 ct may be supported by a cone with an included angle of between about 60° and about 110° and a diameter at the opening of about 4 mm. Further examples of suitable aperture configurations are provided in FIGS. 4A to 4D, which show nozzles 105*a*, 105*b*, 105*c*, 105*d* which could be used in place of the conical profile of the aperture 105 shown in FIG. 1.

The upper and lower members 102, 104 need not be separate entities and may be combined into one piece. However, the arrangement shown enables the use of interchangeable upper members 104 so that different sized and or shaped apertures 105 may be provided to suit different sized or shaped diamonds.

Generally there will be other apparatuses which may be characterised in having an axis 108 oriented in a vertical direction (parallel to the prevailing apparent gravitational field). This axis 108 may be considered to define both the nominal position of the desired centreline of the diamond 106, and the direction normal to the table facet 109 of the diamond 106, corresponding to a "perfect" alignment. The apparatus is shown schematically in FIG. 1 as a CCD camera 107 but may include other viewing means, marking apparatus etc. Other elements of the apparatus should be arranged with respect to this vertical axis.

It is not essential that the upper and lower members 102, 104 are aligned perfectly with this vertical axis. This freedom allows the lower member 102 to be supported on a two axis goniometer 110, to provide additional fine adjustments to the orientation of the diamond if required. For example, suppose that the camera 107 has mounted thereon a directional light source (not shown) that directs light along the axis 108. When the diamond 106 is correctly aligned with the table 109 horizontal, light from the light source will be specularly reflected directly back into the camera 107. If the diamond 106 is not perfectly aligned but the offset from perfect alignment is small, the specular reflection will still pass through the aperture of the camera 107, and an operator will be able to see how the orientation needs to be changed to get the alignment exact. If the offset is sufficiently large that the specular reflection does not pass into the camera 107, adjustment with the goniometer 110 becomes a guess. The upper and lower members 102, 104 need to be well enough aligned that, when the diamond 106 is aligned using the method described below, a specular reflection from the table 109 will pass back into the aperture of the camera 107.

The lower member 102 is provided with a spigot 111 (or other suitable means), via which a tube 112 is connected. The tube 112 leads via a needle valve 113 and hydraulic accumulator chamber 114 to a pump 115 through one of a pair of diverter valves 116, 117. One of the diverter valves 116 is connected to a low pressure (near vacuum) outlet 118 of the pump 115, and the other diverter valve 117 is connected to a high pressure outlet 119 of the pump 115. The pump 115 may also be switched on or off by an electrical switch (not shown).

The needle valve 113 and accumulator 114 provide an adjustable flow limiting aperture and a reservoir of air of elevated or reduced pressure so that when the pump is turned on or off, or operated as a vacuum pump, the change in air pressure at the aperture 105 takes place over a controlled period of time, typically over the course a few tenths of second or few seconds.

The apparatus is designed to allow a gradual transition from a first state where the diamond 106 is caused to "float" above the upper member 104 by the application of a positive pressure differential between its lower and upper sides, to a second state in which the diamond is allowed to settle gently into the aperture 105 of the upper member 104.

Figure 2:
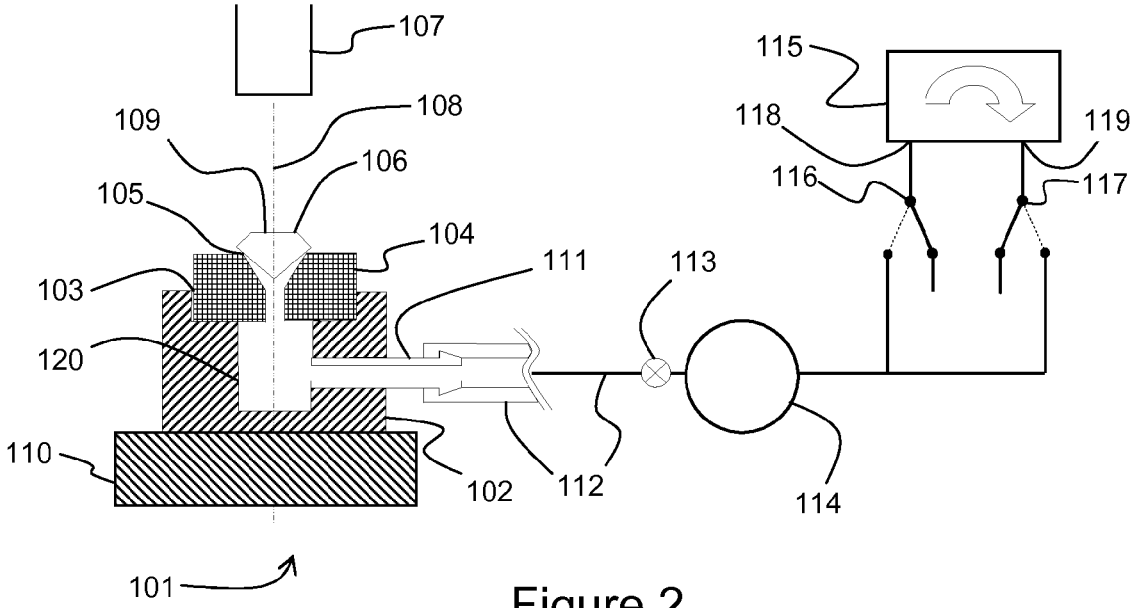
FIG. 2 illustrates the alignment mechanism of FIG. 1 when the air pressure has been reduced and the gemstone has settled in an aligned position.

This transition can be understood with reference to FIGS. 1 and 2. FIG. 1 illustrates how the first state is obtained. A clean round brilliant diamond 106 is placed into the aperture 105 in the upper member 104. The pump 115 is activated and the diverter valves 116, 117 are set so that the high pressure outlet 119 is connected to the accumulator 114. This generates a high pressure in the accumulator 114, and air flows through the needle valve 113, tube 112 and spigot 111 into a chamber 120 formed in the lower member 102 under the diamond 106, and thus through the aperture 105. This creates sufficient differential pressure between the lower and upper sides of the diamond 106 to cause it to lift clear of the upper member 104 and float with the table facet 109 approximately horizontal with air flowing around the diamond 106.

The transition to the second state is triggered by switching the diverter valve 117 so that the high pressure outlet 119 of the pump 115 is no longer connected to the accumulator 114 and tube 112, as shown in FIG. 2. The port on the accumulator 114 facing towards the pump 115 is now blocked, and the pressure in the accumulator 114 discharges slowly through the needle valve 113 as air flows around the diamond 106, the pressure slowly diminishing until the diamond 106 settles in a stable aligned position.

While any operating fluid may be used, it is convenient to use air. By allowing the diamond 106 to float on an air cushion, a virtually frictionless interface is provided between the diamond 106 and the upper member 104. In the initial flotation there may be some turbulence or instability, inducing uncontrolled random movements of the diamond 106. However, as the pressure differential is reduced (over a time scale of a few tenths of seconds to a few seconds) the flow becomes more stable and the reduction in friction allows the diamond to settle into a position of minimum potential energy. The dynamics of this process are influenced beneficially by the tendency for the diamond 106 to act as a restrictor to the flow of air: direct observation of the settling process shows it to proceed by a series of almost random but diminishing jumps which lead to final settling at a consistent minimum energy position.

For symmetrical diamonds, this minimum will correspond to the desired alignment where the table facet 109 is horizontal and hence its normal is vertical. For stones, including round brilliant stones, with minor but measurable deviations in symmetry, the minimum potential energy of the stone may present the table normal slightly tilted to the vertical axis. Depending on the requirement of subsequent observations, measurements or processes, this residual tilt may be negligible, and ignored, or mechanical adjustments such as offered by the two axis goniometer 110 may be used to refine the alignment. Alternatively, as the method generally produces repeatable alignments, it may be decided to define the desired alignment as the one corresponding to the minimum potential energy.

It will be appreciated that the minimum potential energy could be a local minimum and, if so desired, the diamond can also be aligned in a position whereby the table facet of the diamond rests lowermost instead of uppermost relative to the nozzle.

It will be appreciated that the diamond 106 could be floated on a cushion of air if the tube 112 is connected directly to the high pressure outlet 119 of the pump. However, the needle valve 113, accumulator 114 and diverter valve 117 allow control over the reduction in pressure beneath the diamond so that it takes place over a finite period of time, typically of the order of a few tenths of a second or a few seconds. It will be appreciated that other ways of controlling the reduction in pressure could also be used. For example, a mechanically controlled needle valve (not shown) could be gradually closed to reduce the air flow and thus the pressure beneath the diamond 106, or a variable speed pump could be used. However, the accumulator 114 ensures that the reduction in pressure takes place over a suitably long period of time, and is reliable and cheap.

The chamber 120 allows airflow to divert from horizontal to vertical in the arrangement shown. However it will be appreciated that, in some arrangements, the chamber may not be needed. In other arrangements the chamber may be optimised to introduce desirable airflow effects to improve settling of the diamond. For example, the airflow effects may increase or decrease spinning of the stone, or provide better stabilisation. Thus the chamber may be, for example, curved around, rifled or vaned.

The apparatus may be provided with both illumination and electronic viewing means such as the CCD camera 107, aligned coaxially with the vertical axis 108. It is possible to verify, by examination of the strength of the reflected light from the table facet whether the alignment has been successful. If an error is detected, the alignment may either be repeated or mechanical adjustments made. Even if final adjustments are required the method still offers practical benefits by bringing the diamond closely enough into an alignment that a reflection from the table may be observed.

Figure 3:
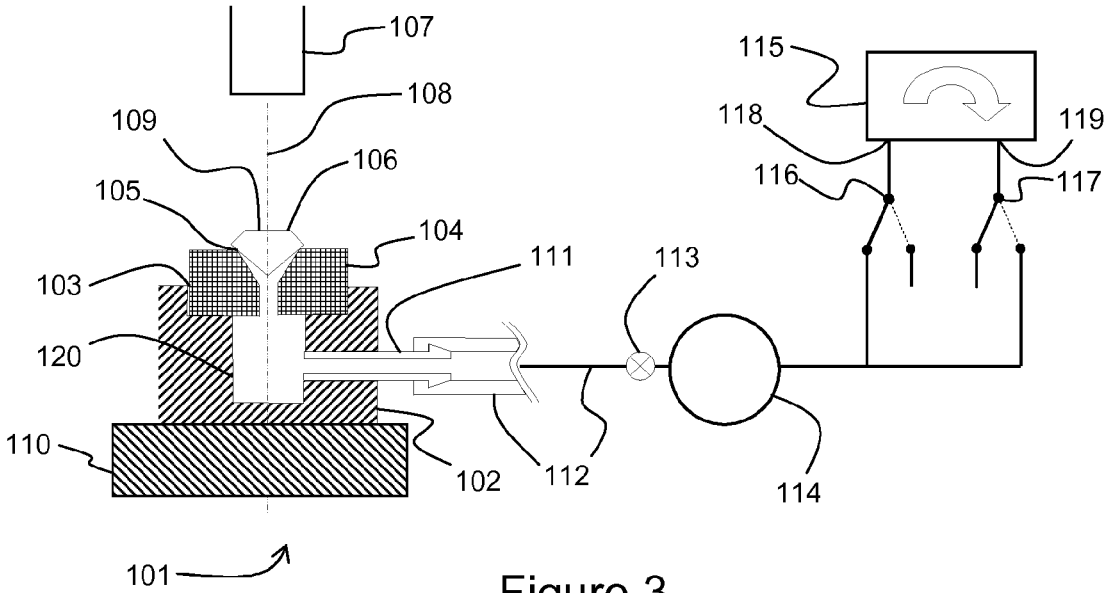
FIG. 3 illustrates the alignment mechanism of FIG. 1 with a vacuum applied beneath the gemstone so that it is held in position by atmospheric pressure.
Figure 4A:
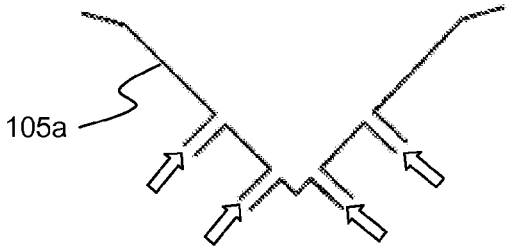
FIGS. 4A to 4D illustrate alternative nozzle configurations.
Figure 4B:
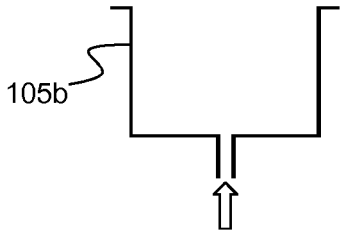
Figure 4C:
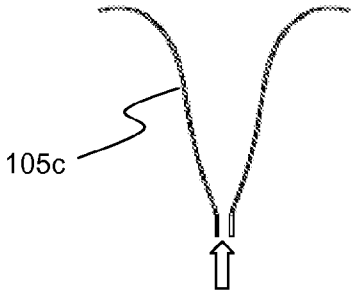
Figure 4D:
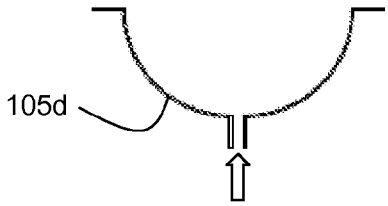

The illustrated apparatus also enables a transition to a further state in which the diamond is held firmly in place by means of a negative pressure differential, and this is illustrated in FIG. 3. Once the diamond 106 has settled in to the aperture 105, the diverter valve 116 attached to the low pressure (vacuum) outlet 118 of the pump 115 is operated so that the accumulator 114 is connected to the low pressure outlet 118. The pump 115 now acts to draw air from the upper and lower members 102, 104, causing a negative pressure differential between the upper and lower surfaces of the diamond 106. Atmospheric pressure acting on the upper surface of the diamond 106 now holds it in place in the aperture 105. By building up this negative pressure differential in a controlled manner it is possible to minimise any undesirable movement of the diamond.

It will be appreciated that it would be possible to go directly from the configuration shown in FIG. 1 to the configuration shown in FIG. 3 without the intermediate step shown in FIG. 2. In other words, the pump 115 could be switched directly from providing a positive air pressure differential which ensures that the diamond 106 is held above the aperture 105, to a negative air pressure differential which ensures that the diamond 106 is held in place in the aperture 105, as long as the transition between the two states is sufficiently long to allow the diamond 106 to settle in place.

EXAMPLE

An apparatus in accordance with FIG. 1 was assembled. The upper member 104 was machined from Delrin® and was machined with a aperture 105 in the shape of a cone with an included angle of 60° and an opening diameter of 4 mm. The lower member 102 was machined from aluminium alloy and was fitted with a threaded spigot 111 to attach the tube 112. The distance from the upper face of the upper member 104 to the underside of the lower member was 14 mm. The lower member was attached to a two axis goniometer. This was in turn mounted with an adapter to the shaft of a stepper motor with a hollow shaft, mounted vertically. The tube 112 was extended via a further simple connector above the motor through a bore in the adapter and a right angle swivel connector at the lower end of the hollow shaft so the goniometer and the upper and lower members 102, 104 could be rotated around the central axis 108 without twisting the tube 112.

Viewing means were mounted directly above the central axis 108 incorporating an imaging lens and a coaxial illuminator incorporating a beamsplitter. To align the apparatus, a mirror was placed onto the upper surface of the upper member 104 and the goniometer 110 adjusted until a bright reflection was obtained. It was observed that the strength of the reflection was unaltered as the stepper motor shaft was rotated, confirming that the axis of illumination was aligned that of the imaging means and the motor. A small spirit level was then placed onto the upper surface of the upper member 104 and this confirmed that the surface was horizontal. The aperture of the imaging system was set to have a Numerical Aperture of 0.0125 in the object space corresponding to an acceptance angle of approximately 1.4°. Experiments with the goniometer confirmed that the alignment had to be correct to within approximately 1° to obtain a bright reflection. The aperture settings were significantly smaller than those used in a practical instrument in order to test the alignment method.

Alignment tests were carried out on a selection of 10 round brilliant diamonds ranging from 0.19 ct to 1.00 ct. In every case except one a bright reflection was obtained repeatably and consistently, provided the needle valve was set to allow the diamond to settle gently. It was found that no adjustments to the needle valve were needed over the size range tested.

These results could be reproduced even if there was a tilt between the normal of the upper surface of the upper member 104 and the vertical axis 108 of up to 5°, and to a lesser extent up to 10°, showing that the orientation was generally to the vertical direction rather than to the normal to the upper surface of the upper supporting member 104.

By contrast, if the pressure drop was carried out abruptly so that the floating diamond was dropped quickly into the aperture by, for example, pinching the tube 112, alignment generally did not occur.

One diamond settled consistently in an orientation that did not produce a bright reflection at the test aperture settings. Measurement on this stone with a Sarin Diamension system showed that the crown and pavilion angles varied by 1.4 and 1.9 degrees respectively so that the stone was unsymmetrical enough to not settle with the table horizontal, but it was possible to adjust the goniometer to bring it into alignment, guided by the strength of the bright reflection.

In most cases application of a negative pressure differential or vacuum caused slight but tolerable movements to the orientation of the diamond and these movements could be reduced by controlling the rate at which the vacuum was applied.

It will be appreciated that variations from the arrangement described above may still fall within the scope of the invention. For example, as noted above, the supporting members have been described as comprising an upper and lower member, but a single unit would also be possible. Furthermore, any suitable arrangement for controlling the pressure beneath the diamond could be used.

It will also be appreciated that the system has been described with reference to aligning a diamond or gemstone, but could be used to align any article having a regular shape or symmetry so that alignment can be achieved by the article gradually settling into an aperture under gravity.

It will also be noted that, in the arrangement shown in the figures, the diamond 106 is shown as supported with the table 109 above the upper surface of the upper member 104. If the diamond 106 smaller, it can be envisaged that the diamond might be supported entirely within the conical part of the aperture 105, with the table 109 below the top surface. This would potentially lead to problems removing the diamond from the apparatus, but could still be used to align the diamond for viewing, measurement, observations, marking etc.

The invention claimed is:

1. An apparatus for aligning an article with a predetermined vertical axis, comprising:

a nozzle, extending upwardly and aligned with the vertical axis in use and configured to allow the article to settle in an upper side thereof under the action of gravity so that the article is supported by the nozzle at a point of minimum potential energy; and a fluid supply system for supplying fluid to the nozzle under sufficient pressure to support the article within or above the nozzle, the fluid supply system including a fluid pressure control system for controlling the pressure of fluid supplied to the nozzle, wherein the fluid pressure control system is arranged to reduce the fluid pressure supplied to the nozzle to a predetermined pressure which is not sufficient to support the article within or above the nozzle gradually over a finite period of time, allowing the article to settle gradually into the nozzle at the point of minimum potential energy.

2. The apparatus of claim 1, wherein the fluid is air.

3. The apparatus of claim 1, wherein the finite period of time is in the range of about 0.1 seconds to about 10 seconds.

4. The apparatus of claim 1, wherein the predetermined pressure is atmospheric pressure.

5. The apparatus of claim 1, wherein the predetermined pressure is below atmospheric pressure so that there is a negative pressure differential beneath the article when it is supported by the nozzle.

6. The apparatus of claim 1, wherein:

the fluid supply system includes a pump arranged to deliver high pressure fluid towards the nozzle along a fluid path and a diverter valve for interrupting the supply of high pressure fluid; and the fluid pressure control system is provided in the fluid path and arranged to elongate the timescale of a fluid pressure change at the pump so that, when the supply of high pressure fluid from the pump is interrupted, the fluid pressure at the nozzle is reduced over the finite period of time.

7. The apparatus of claim 6, wherein the fluid pressure control system includes a hydraulic accumulator.

8. The apparatus of claim 6, wherein the fluid pressure control system includes a needle valve.

9. The apparatus of claim 6, wherein the diverter valve includes a high pressure valve attached to a high pressure outlet of the pump, the high pressure valve movable between an activated state, in which the high pressure fluid is directed towards the nozzle along the fluid path, and an inactivated state, in which the high pressure fluid is not directed through the fluid path towards the nozzle.

10. The apparatus of claim 6, wherein the pump includes a low pressure outlet connectable to the fluid path, so that a low fluid pressure or vacuum can be generated at the nozzle beneath the article to enable the article to be held in place by atmospheric pressure.

11. The apparatus of claim 10, wherein the fluid control system is arranged to ensure that the low fluid pressure or vacuum is generated at the nozzle gradually over a second finite period of time.

12. The apparatus of claim 10, wherein the fluid control system is arranged to reduce the fluid pressure at the nozzle from the pressure sufficient to support the article within or above the nozzle to the low fluid pressure or vacuum continuously.

13. The apparatus of claim 1, wherein an upward facing portion of the nozzle is generally internally conical.

14. The apparatus of claim 13, wherein the included angle of the conical portion of the nozzle is in the range about 60° to about 110°.

15. The apparatus of claim 1, wherein the nozzle is formed as an aperture in a support member.

16. The apparatus of claim 15, wherein the support member is formed from a lower member and a removable upper member, the aperture being provided in the upper member.

17. The apparatus of claim 15, further comprising a two-axis goniometer on which the support member is mounted.

18. The apparatus of claim 15, wherein the support member is made from or lined with polyoxymethylene plastic.

19. The apparatus of claim 1, further comprising a chamber formed beneath the nozzle for controlling the flow of fluid into the nozzle.

20. The apparatus as claimed in claim 1, wherein the article is a gemstone.

21. An assembly for viewing a gemstone, comprising the apparatus of claim 1 and a viewing apparatus aligned along the vertical axis for viewing a gemstone located in the nozzle.

22. A method of aligning an article with a vertical axis, comprising:

providing an apparatus having, a nozzle, extending upwardly and aligned with the vertical axis in use and configured to allow the article to settle in an upper side thereof under the action of gravity so that the article is supported by the nozzle at a point of minimum potential energy; and a fluid supply system for supplying fluid to the nozzle under sufficient pressure to support the article within or above the nozzle, the fluid supply system including a fluid pressure control system for controlling the pressure of fluid supplied to the nozzle, wherein the fluid pressure control system is arranged to reduce the fluid pressure supplied to the nozzle to a predetermined pressure which is not sufficient to support the article within or above the nozzle gradually over a finite period of time, allowing the article to settle gradually into the nozzle at the point of minimum potential energy;

placing the article in the upwardly extending nozzle aligned with the vertical axis;

supplying fluid under pressure to the nozzle;

supporting the article on a fluid cushion within or above the nozzle; and gradually reducing the pressure of the fluid over a finite period of time so as to allow the article to settle in the nozzle under gravity so that it is supported by the nozzle at a point of minimum potential energy.

23. A method of leveling a top surface of an article, comprising:

providing an apparatus having, a nozzle, extending upwardly and aligned with the vertical axis in use and configured to allow the article to settle in an upper side thereof under the action of gravity so that the article is supported by the nozzle at a point of minimum potential energy; and a fluid supply system for supplying fluid to the nozzle under sufficient pressure to support the article within or above the nozzle, the fluid supply system including a fluid pressure control system for controlling the pressure of fluid supplied to the nozzle, wherein the fluid pressure control system is arranged to reduce the fluid pressure supplied to the nozzle to a predetermined pressure which is not sufficient to support the article within or above the nozzle gradually over a finite period of time, allowing the article to settle gradually into the nozzle at the point of minimum potential energy;

placing the article in the upwardly extending nozzle;

supplying fluid under pressure to the nozzle;

supporting the article on a fluid cushion within or above the nozzle; and gradually reducing the pressure of the fluid over a finite period of time so as to allow the article to settle in the nozzle under gravity so that it is supported by the nozzle with its too surface level.

24. The method of claim 22, wherein the fluid is air.

25. The method of claim 22, wherein the article is a gemstone.

26. The method of claim 22, further comprising:

supplying high pressure fluid from a pump;

storing the high pressure fluid in a hydraulic accumulator;

passing the high pressure fluid through a needle valve to the lower side of an aperture in the nozzle;

interrupting the supply of the high pressure fluid from the pump; and allowing the high pressure fluid in the accumulator to discharge through the needle valve so as to reduce the fluid pressure at the aperture gradually.

27. The method of claim 22, further comprising gradually reducing the fluid pressure below atmospheric pressure so as to hold the article in place in the nozzle.

28. The method of claim 22, wherein the nozzle is formed as an aperture in a top surface of a support member.

29. The apparatus of claim 20, wherein the gemstone is a round brilliant cut gemstone.

30. The apparatus of claim 29, wherein the nozzle is configured so that a pavilion of the gemstone can settle into the nozzle.

31. The apparatus of claim 29, wherein the nozzle is configured so that a table facet of the gemstone will be generally horizontal when the gemstone has settled at the point of minimum potential energy.

* * * * *